United States Patent [19]

Rudoy

[11] Patent Number: 4,995,827

[45] Date of Patent: Feb. 26, 1991

[54] STRAIN RELIEF IDC CONNECTOR

[75] Inventor: Edward Rudoy, Woodland Hills, Calif.

[73] Assignee: ITT Corporation, New York, N.Y.

[21] Appl. No.: 553,060

[22] Filed: Jul. 16, 1990

[51] Int. Cl.[5] ..... H01R 4/24

[52] U.S. Cl. ..... 439/405; 439/417; 439/468

[58] Field of Search ..... 439/395, 404, 405, 399, 439/400, 401, 460, 465, 468, 417, 418, 419, 492–499; 29/857, 866

[56] References Cited

U.S. PATENT DOCUMENTS

| | | | |
|---|---|---|---|
| 3,162,501 | 12/1964 | Wahl | 339/98 |
| 3,432,794 | 3/1969 | Churla | 339/17 |
| 3,713,073 | 1/1973 | Narozny | 339/17 |
| 3,795,885 | 3/1974 | Desso et al. | 339/17 |
| 3,824,530 | 7/1974 | Roberts et al. | 439/399 X |
| 4,006,957 | 2/1977 | Narozny | 339/103 |
| 4,068,912 | 1/1978 | Hudson, Jr. et al. | 339/99 |
| 4,111,512 | 9/1978 | Parmer et al. | 339/105 |
| 4,209,219 | 6/1980 | Proietto | 339/99 |
| 4,351,579 | 9/1982 | Kordes et al. | 339/14 |
| 4,406,511 | 9/1983 | Hayes | 339/103 |
| 4,428,638 | 1/1984 | Greenwood | 439/465 |
| 4,538,873 | 9/1985 | Worth | 339/99 |
| 4,548,460 | 10/1985 | Dozsa et al. | 339/107 |
| 4,636,024 | 1/1987 | Yahata | 339/103 |
| 4,705,482 | 11/1987 | Endo et al. | 439/492 X |
| 4,710,137 | 12/1987 | Perdue et al. | 439/465 X |
| 4,713,025 | 12/1987 | Soma | 439/752 |
| 4,756,940 | 7/1988 | Payne et al. | 428/78 |
| 4,776,803 | 10/1988 | Pretchel et al. | 439/59 |
| 4,932,895 | 6/1990 | van de Kerkhof | 439/417 |

FOREIGN PATENT DOCUMENTS

| | | | |
|---|---|---|---|
| 0096484 | 12/1983 | European Pat. Off. | 439/418 |
| 2228780 | 1/1974 | Fed. Rep. of Germany | 439/468 |
| 3122611 | 1/1983 | Fed. Rep. of Germany | 439/418 |

*Primary Examiner*—David L. Pirlot
*Assistant Examiner*—Julie R. Daulton
*Attorney, Agent, or Firm*—Thomas L. Peterson

[57] ABSTRACT

An insulation displacement connector is described, of the type that includes a cap (26) that can push a ribbon cable or discrete wires (12) into insulation displacement contacts (20) projecting from the top of an insulative body (14) until the cap latches to the body, which provides strain relief for the cable in a simple construction. The cap includes a cover part (44) that presses down on the cable and an elongated cable support (60) lying under one side of the cover part to enable the cable to be threaded between the cover part and the cable support. The cable support is connected to the cover part by bendable arms (74,76), and the insulative body has a deflecting surface (90) that deflects the cable support upwardly as the cap is pushed down, to squeeze the cable between the cable support (60) and the side (46) of the cover part for strain relief.

8 Claims, 2 Drawing Sheets

STRAIN RELIEF IDC CONNECTOR

BACKGROUND OF THE INVENTION

One type of insulation displacement connector includes an insulative body and contacts mounted in the body and having insulation displacement ends projecting from the upper surface of the body. A ribbon cable or group of discrete wires is laid over the insulation displacement ends of the contacts, and a cap is placed over the cable and pressed down. When the cap is pressed sufficiently to latch to the body, the wires of the ribbon cable will have been terminated, or connected, to the contacts.

In many applications, a strain relief apparatus is required to securely hold the cable or wires to the connector at a location between the contacts and the long cable portion extending from the connector. Previously, separate screwtightened clamps or the like were used to squeeze the cable against the connector location after the cap had been latched to the body. However, a cap and body which provided strain relief as the cap was depressed, without the need for separate parts to be separately fastened and without increasing the height of the connector, would be of considerable value.

SUMMARY OF THE INVENTION

In accordance with the embodiment of the present invenntion, an insulation displacement connector is provided for connecting to the conductors of insulated wires such as those of a ribbon cable, and for providing strain relief, in a simple, low profile, and low cost manner. The connector includes contacts with insulation displacement ends projecting from the upper end of an insulative body, and a cap with a cover part that presses the cable wires down towards the upper end of the body. The cap latches to the body when the cap has been fully depressed so it has terminated the wires to the contacts. The cap includes at least one elongated cable support lying near a side of the cover part of the cap, so the cable can be threaded between them. As the cap is depressed to push down the cable, a deflecting surface on the body deflects the cable support largely upwardly to squeeze the cable between the cable support and a side of the cover part, to thereby provide strain relief.

The deflecting surface of the body preferably extends at a large angle to the horizontal, so it requires only a small additional downward force on the cap to produce cable support deflection. The cable support preferably has a sharp inner corner lying under one extreme side of the cover part, to facilitate threading a cable between them and to provide enhanced strain relief.

The novel features of the invention are set forth with particularity in the appended claims. The invention will be best understood from the following description read in conjunction with the accompanying drawings.

BRIEF DESCIPTION OF THE DRAWINGS

DESCRIPTION OF THE PREFERRED EMBODIMENT

Figure 1:
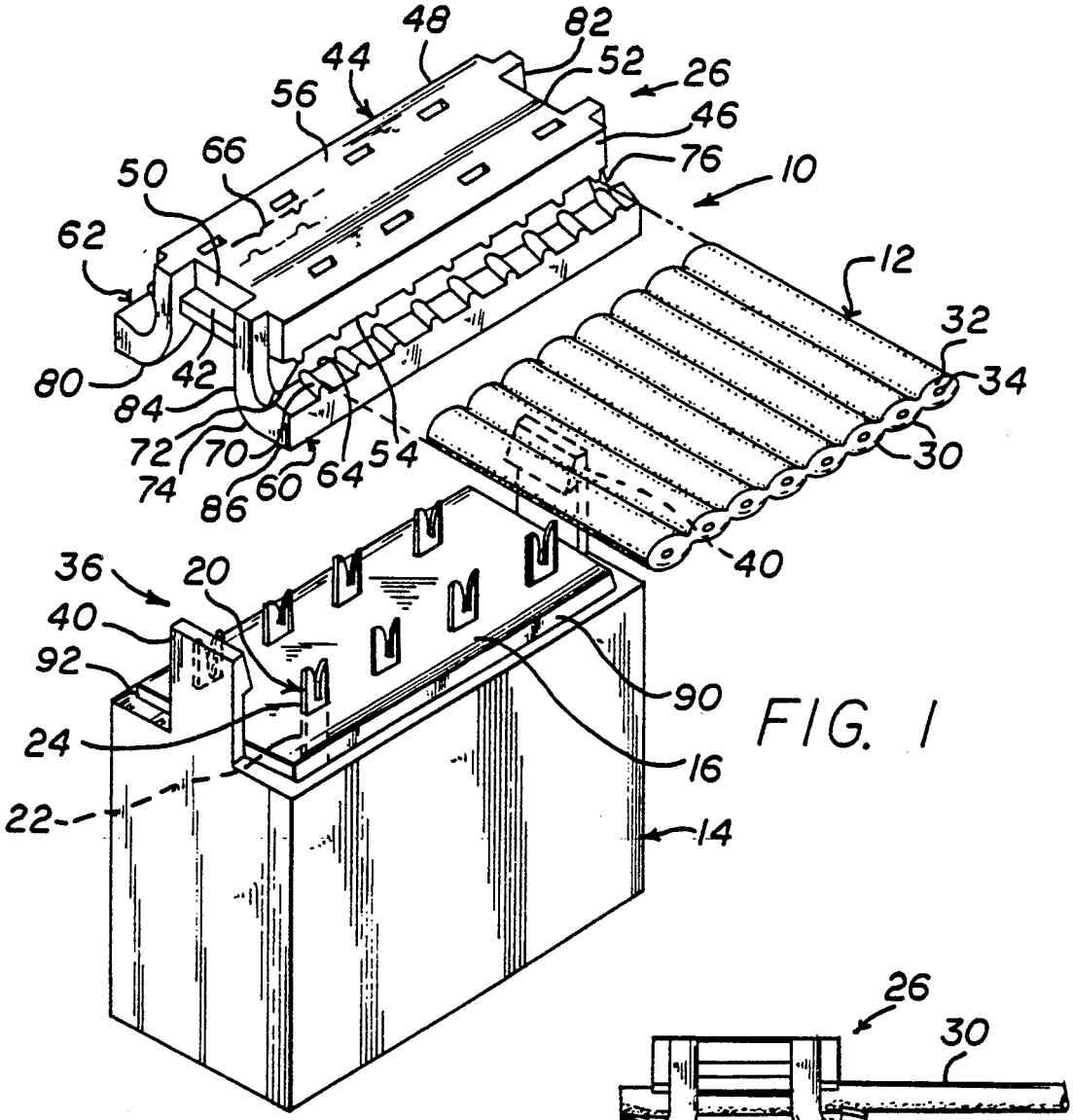
FIG. 1 is an exploded perspective view of a connector constructed in accordance with the present invention, and of a ribbon cable that can be terminated to the connector.
Figure 3:
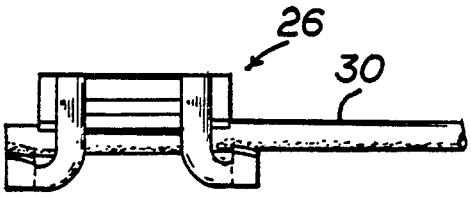
FIG. 3 is an end elevation view of the cap and cable of FIG. 2.
Figure 2:
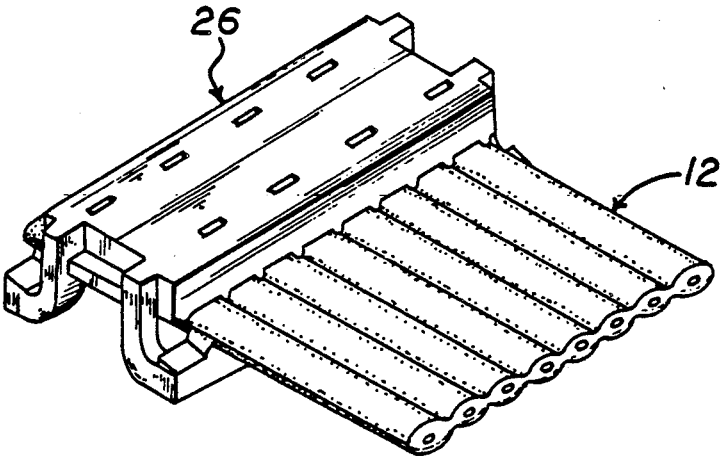
FIG. 2 is a perspective view of the cap and cable of FIG. 1, with the cable installed on the cap and with the combination ready for installation on the body of the connector.

FIG. 1 illustrates an insulation displacement connector 10 of the type that is used with a group of wires such as of ribbon cable 12. The connector includes an insulative body 14 having an upper and 16. A plurality of contacts 20 are arranged with portions 22 lying in the body and with insulation displacement ends 24 projecting from the uppre end of the body. A cap 26 is used to press down against the ribbon cable 12 to press it towards the upper ennd 16 of the body. During such pressing, wires 30 of the ribbon cable are pressed against the insulation displacement ends 24 of the contacts, to displace the insulation 32 of each wire and engage the central conductor 34 of the wire. When the cap is fully installed, it is latched in place by a latch apparatus 36 that includes a pair of latches 40 on the body that engage a pair of strikes 42 on the cap. It should be noted that, while terms such as "upper", "downwardly", etc. are used herein to describe the relative positions and directions shown in the drawings and to help understand the invention, the parts can be used in any orientation relative to the earth's surface.

The cap 26 includes a cover part 44 with opposite sides 46, 48 and opposite ends 50, 52. The ribbon cable is intended to lie under the lower surface 54 of the cover part, while downward force is usually applied to the upper surface 56 of the cover part. The cap also includes a pair of elongated cable supports 60, 62 lying under and near the opposite sides 46, 48 of the cover part and extending parallel to the cover part sides. The slot or space 64, 66 between each cable support and a corresponding side of the cover part is about equal to the thickness of the ribbon cable 12.

The connector is assembled by first threading the ribbon cable 12 through the space 64 between the first cable support 60 and the first side 46 of the cover part, along the lower surface 54 of the cover part, and through the space 66 between the second cable support 62 and the second side 48 of the cover part. The cable supports and cover part have ribs 70, 72 which receive the recesses in the ribbon cable that divided it into the individual wires, to accurately guide the ribbon cable into place. With the ribbon threaded through the cap, the cap is placed over the insulative body, and the cap is pushed downwardly. The cap is guided in its downward movement by the sides of the latches 40. When the cap has been depressed to its fully installed position, wherein the insulation of the cable wires has been displaced and the wire conductors engage the contacts, the latches 40 engage the strikes 42 to hold down the cap and the cable.

The cable supports 60, 62 of the cap, are held on the cover part 44 by pairs of elongated arms, including a first pair of arms 74, 76 that support the first cable support 60, and a second pair of arms 80, 82 that support the second cable support 62. Each of the arms such as 74 extends from an end such as 50 of the cover part, and each arm has both vertical and horizontal portions 84, 86. The arms can bend, to allow the cable supports to move upwardly slightly, so as to squeeze the ribbon cable.

Figure 5:
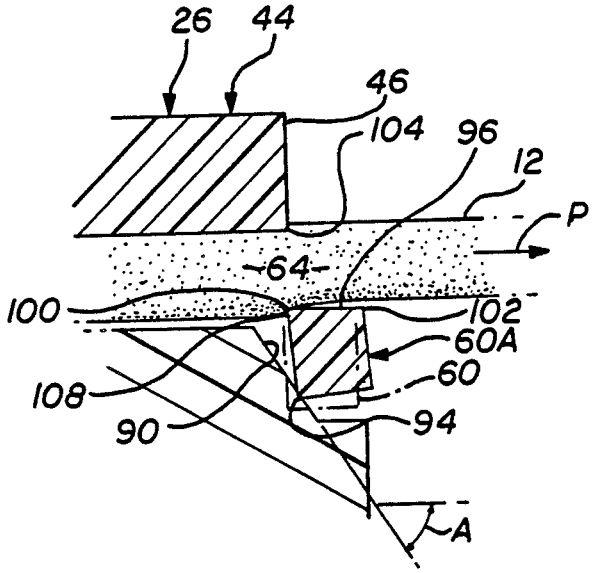
FIG. 5 is a sectional view of a portion of the connector of FIG. 4.

The insulative body 14 has deflecting surfaces 90, 92 that are designed to engage the cable supports 60, 62 and deflect them upwardly as the cap is pushed down. As shown in FIG. 5, each cable support such as 60 has a body-engaging part 94 that presses against a corresponding deflecting surface 90 as the cap 26 is depressed. This results in the cable support 60 being deflected upwardly to position 60A relative to the cover part 44, which results in narrowing the space or gap through which the ribbon cable 12 extends. It would be possible to orient the deflecting surface 90 horizontally. However, only a small upward movement of the cable support 60 relative to the cover part is required, and yet the cap moves down a substantial distance during its installation. Applicant orients the deflecting surface 90 at a large angle A from the horizontal direction indicated by line 96. This results in deflection of the cable support 60 over a substantial part of the cap downward movement, and in less resistance to downward movement of the cap. It can be seen that the cable support at 60A originally assumed a position 60 relative to the cover part, but has been deflected largely upwardly to the position 60A.

If the ribbon cable was initially closely received in the space 64, then deflection of the cable support 60 will result in the cable being squeezed. This results in strain relief for the cable, in that any pulling of the cable in the direction P will initially be resisted by the squeeze cable portion lying in the space 64. This will protect the terminated portions of the cable where the insulation has been sliced through and the insulation displacement ends 24 of the contacts are engaging the conductors of the cable. The fact that the cable support 60 is automatically deflected as the cap is installed, avoids the need for separate strain relief devices that have to be separately installed.

Figure 4:
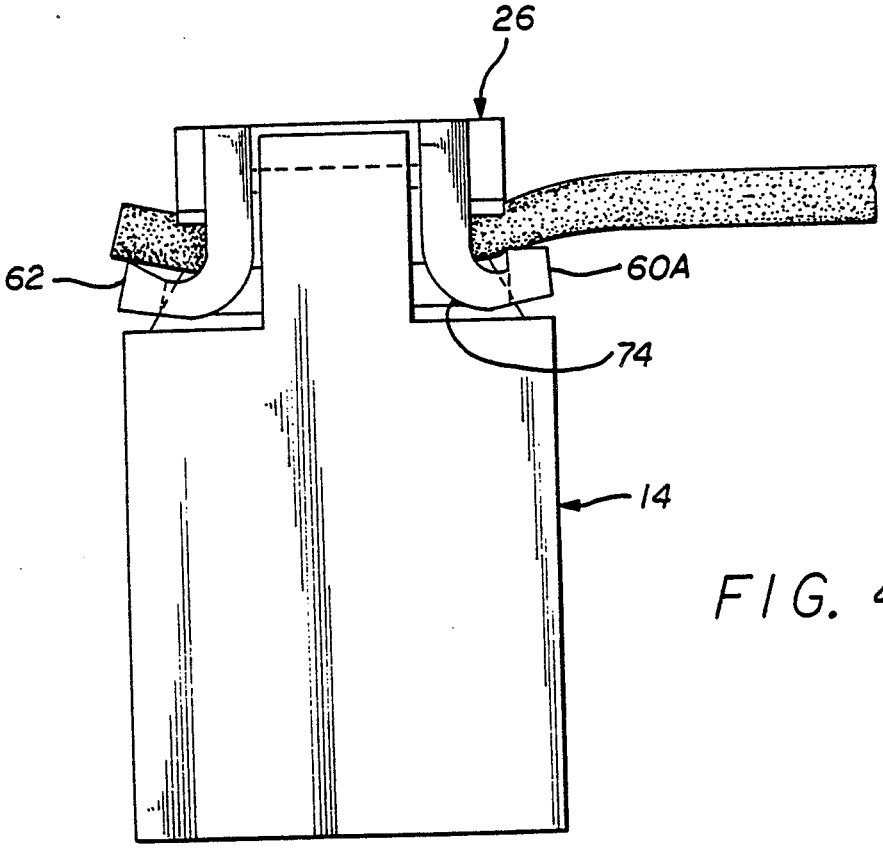
FIG. 4 is an end elevation view of the connector cable of FIG. 1 with the cap in a fully installed position.

The cable support 60 can be upwardly deflected, because it is held by the pair of elongated arms such as 74 (FIG. 4) which have a greater length than their thickness. The cable support 60 (FIG. 5) has an upper surface 96 with an inside corner 100 and an outside corner 102. Applicant perfers to place the cable support with its inside corner 100 lying substantially under the outside corner 104 of the corresponding side 46 of the cover part. This results in the ribbon cable 12 having to be threaded only between two adjacent corners 10, 104, which makes threading easier where the space between the corners is equal to the thickness of the cable without extra space between them. In addition, when the cable support 60 is upwardly deflected, its inside corner 100 is the principle part that squeezes the local area of the ribbon cable. The inside corner 100 is relatively sharp, in that it has a small radius of coverture less than 1/10th the thickness of the space 64 between the cable support corner 100 and the cover part corner 104. This results in the inside surface 108 of the cable support forming a ledge that can "dig into" the cable to greatly resist the pulling out of the cable.

The second cable support 62 (FIG. 4) does not have to provide strain relief, and is used primarily to support the cut end of the cable to align it with the contact ends.

Thus, the invention provides an insulation displacement connector of the type that has a cap that presses the wires of a ribbon cable towards the upper end of a body where there are outstanding insulation displacement contact ends, which provides strain relief for the wires. The cap includes a cover part that pushes down the cable, and at least one cable suppport lying a distance under one side of the cover part to allow the cable to be threaded between them. The cable support can be deflected in a largely upward direction, and the body has a deflecting surface that upwardly deflects the cable support as the cap is pushed dopwn towards its fully installed position. As a result, the cable is squeezed between the cable support and a side of the cover part to provide strain relief. The cable support preferably has an upper face with a sharp inner corner lying under a side of the cover part, so the cable has to be threaded only between adjacent corners. The deflecting surface on the body which deflects the cable support, preferably extends at an angle from the horizontal, to produce a small deflection over a long travel of the cap to its fully installed position.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. An insulation displacement connector for connecting to the conductors of cable wires comprising:

an insulative body having an upper end;

a plurality of contacts with portions lying in said body and with insulation displacement ends projecting from said body upper end;

a cap constructed to be pressed down toward said body upper end, to press the wires of a cable into said contact insulation displacement ends, said cap and body having a latch apparatus for holding said cap on said body;

said cap having a cover part with opposite sides and opposite ends, and at least one elongated cable support lying near a first of said cover part sides and extending parallel to said cover part side, said cable support spaced from said cover part by about the thickness of said wires, so said wires can be threaded between said cover part and said cable support and under said cover part, said cable support being supported on said cover part to allow said cable support to be deflected closer to said cover part, and said body having a deflecting surface positioned to engage said cable support and deflect it relative to said cover part to squeeze said wires therebetween, whereby to provide strain relief.

2. The connector described in claim 1 wherein:

said at least one cable support includes a pair of cable supports lying respectively near said opposite sides of said cover part but spaced from said cover part by about the thickness of said wires;

said insulation displacement ends are arranged to terminate a cable of predetermined width;

each of said cable supports has a length at least as great as said predetermined cable width to support the entire width of a cable of said width, and said cover includes a pair of arms extending between each end of each cable support and said cover part.

3. The connector described in claim 1 wherein:

said cable support has opposite ends and said cap includes a pair of elongated arms that each extend between said cover part and one end of said cable support;

said body deflecting surface extends at an incline from a horizontal direction.

4. The connector described in claim 1 including:

a ribbon cable lying between said cable support and said cover part, said cable support lying under the entire width of said ribbon cable and including a pair of arms extending from said opposite ends of said cover part to locations on said cable support that lie beyond opposite sides of said ribbon cable;

said cap lying against said insulative body and held thereon by said latch apparatus, and said ribbon cable being squeezed between said cable support and cover part.

5. In an insulation displacement connector of the type that includes an insulative body with an upper end wherein said body holds contacts with insulation displacement ends projecting from said body upper end, and a cap with a cover part that can push a cable of predetermined size down toward said body upper end so the wires of the cable enter the contact insulation displacement ends, the cap and body having latch apparatus that holds down the cap on said body the improvement wherein:

said cover part of said cap has opposite ends and opposite sides, said cap includes a pair of cable supports each havig opposite ends, and said cap includes a pair of arms extending from each end of said cover part to an end of one of said cable supports, said arms hold said cable supports so said cable supports lie near said opposite sides of said cover part but are spaced therefrom by aboout the thickness of said cable, so the cable can be threaded between a first of said cable supports and said cover part, under said cover part, and between the second of said cable supports and said cover part;

a first of said cover part sides forms a corner extending parallel to the length of said first cable support, and each of said cable supports has an inside corner lying substantially under said corner of said first cover part side and has an outside edge lying beyond a location under said cover part, said inside corner being sharp, with a radius of curvature less than one-tenth the distance between said first cable support and said cover part corner.

6. The improvement described in claim 5 wherein:

a first of said pair of arms are constructed so they can be bent to allow a first of said cable supports to be deflected towards said cover part;

said body includes a deflecting surface which engages said first cable support to deflect it upwardly before said latch apparatus is engaged, whereby to provide strain relief.

7. The improvement decribed in claim 6 wherein:

said deflecting surface extends at an incline of more than 30° from the horizontal, to lie progressively lower at locations progressively further from said contact end.

8. In a method for terminating the wires of a cable to contact insulation displacement ends that project from the top surface of an insulative body, by positioning a ribbon cable under a cover portion of a cap and pressing the cap toward the body surface until the cap reaches a fully installed position at which the cap is latched to the body and cannot move away from it, the improvement comprising:

initially threading said cable between an elongated cable support and a side cover portion, wherein said cable support is mounted on said cover part to allow said cable support to be largely upwardly deflected;

abutting said cable support as said cap is pressed down, beore said cap reaches its fully installed position, to deflect said cable support closer to said cover part and squeeze said ribbon cable between them as said cap approaches its fully installed position.

* * * * *